United States Patent [19]

Miller

[11] 4,159,593

[45] Jul. 3, 1979

[54] GAME EMPLOYING MOVEMENT TO CONTROL THE OPERATION OF THE GAME

[75] Inventor: Anthony D. Miller, Redondo Beach, Calif.

[73] Assignee: Tomy Corporation, Carson, Calif.

[21] Appl. No.: 865,498

[22] Filed: Dec. 29, 1977

[51] Int. Cl.[2] ..... A63F 7/02

[52] U.S. Cl. ..... 46/42; 46/239; 273/1 M

[58] Field of Search ..... 194/41; 273/1 M; 46/42, 43, 239

[56] References Cited

U.S. PATENT DOCUMENTS

| | | | |
|---|---|---|---|
| 477,871 | 6/1892 | Powell et al. | 194/DIG. 2 |
| 518,617 | 4/1894 | Matern | 194/41 |
| 525,692 | 9/1894 | Cecchi | 194/DIG. 2 |
| 546,265 | 9/1895 | Williams | 194/DIG. 2 |
| 557,235 | 3/1896 | Rule | 194/DIG. 2 |
| 693,640 | 2/1902 | Conner | 194/DIG. 2 |
| 1,511,497 | 10/1924 | Bonini | 46/42 |
| 2,415,780 | 2/1947 | Wolf | 273/105 R |
| 2,590,002 | 3/1952 | Frazier | 273/108 |
| 2,956,807 | 10/1960 | Luchsinger | 273/1 M |
| 3,314,169 | 4/1967 | Wold | 35/32 |
| 3,592,471 | 7/1971 | Swimmer | 273/120 R |
| 3,638,945 | 2/1972 | Breslow | 273/120 R |
| 3,734,502 | 5/1973 | Bolton | 273/1 M |
| 3,758,113 | 9/1973 | Trbovich et al. | 273/120 R |
| 3,934,881 | 1/1976 | Goldfarb et al. | 273/120 R |

FOREIGN PATENT DOCUMENTS

| | | | |
|---|---|---|---|
| 324088 | 1/1930 | United Kingdom | 194/41 |
| 377455 | 7/1932 | United Kingdom | 194/41 |

*Primary Examiner*—Richard C. Pinkham
*Assistant Examiner*—Lawrence E. Anderson
*Attorney, Agent, or Firm*—Edward D. O'Brian

[57] ABSTRACT

A game in which objects are moved from a first location to a second location and then are allowed to move through the action of gravity back to the first location can be constructed so as to utilize this movement back to the first location so as to control the manner in which the objects are moved from the first to the second location. This is accomplished through the use of a lever located so as to be engaged by objects passing from the second to the first location. When a sufficient number of objects are located on the lever, the lever tilts so as to discharge the objects so that they can move back to the first location. Such tilting of the lever permits rotation of a wheel; in turn such rotation is used to establish open and closed paths determining the number of ways that objects can be moved from the first to the second location.

8 Claims, 5 Drawing Figures

GAME EMPLOYING MOVEMENT TO CONTROL THE OPERATION OF THE GAME

BACKGROUND OF THE INVENTION

The invention set forth in this specification is specifically directed toward a game employing object movement to control the operation of the game. In its broader aspects the invention is concerned with the mechanical movement of a lever for use in regulating the rotation of a wheel in accordance with the lever receiving a plurality of objects from a location above the lever. Such an apparatus can be employed in quite a variety of different applications for different purposes.

In games which are intended to be used by comparatively young children it is frequently desired to incorporate a mechanical action such that the child has to perform a comparatively simple, manipulative task or a series of such tasks in order to utilize such games. In games intended to be used by such comparatively young children it is also normally desired to incorporate an appropriate mechanism such that when the task or tasks are completed the child will receive a visual or audio "feedback" signaling that the game has been utilized in the intended manner. In effect such a "feedback" is in the nature of a reward to the child for having mastered the task or tasks employed in using the game.

Many different games have been constructed for use by comparatively young children in such a manner as to provide such a reward or feedback signal to a child indicating that a task or tasks have been satisfactorily performed. It is not considered that an understanding of the present invention requires any sort of a review or detailed discussion of such prior games. There have been so many of such prior games that it is considered that it will be completely impractical to attempt to discuss them in detail in this specification. In general, such prior games have tended to be undesirably expensive to manufacture and/or undesirably unreliable from a mechanical standpoint. As a result of this, it is considered there is a need for new and improved games in which a child is provided a response indicating that a simple task or tasks have been satisfactorily completed during the use of the game.

SUMMARY OF THE INVENTION

A broad objective of the present invention is to provide a new and improved game filling the need indicated in the preceding discussion. The invention is also intended to provide games which are comparatively simple, which are comparatively inexpensive to manufacture and construct, and which are of such a simple mechanical character that there is virtually no chance of their not performing in their desired manner, even after they have been subjected to the abuse normally accorded to toys by comparatively young children.

The invention, however, is considered to be broader than indicated in the preceding. It is intended to provide mechanical apparatus for use in controlling the rotation of a wheel in response to objects being located on a lever. It is considered that such an apparatus can have wide utility in a wide variety of different, diverse games and in other applications in which limited or controlled movement of a wheel in response to the number of objects moving along a path is desirable. Hence, it can be considered that the invention is intended to provide a new and improved apparatus for the purpose of controlling the movement of a wheel in response to such movement of objects, regardless of whether or not the apparatus is employed in a game or in a different type of mechanical application.

In accordance with this invention these objectives are achieved by providing an apparatus in which objects are moved from an upper location to a lower location in which the improvement comprises: an elongated lever located so as to receive objects from the upper location, said lever having a receiving end and a discharge end and being pivotally mounted intermediate said ends, said lever being weighted so that said receiving end will tend to move downwardly when there is no weight applied to said lever, stop means for limiting the downward movement of said receiving end to a position in which said receiving end is located generally beneath said upper location and is positioned so as to receive at least one object passing downwardly from said upper location; said lever being located with respect to said upper location so that when at least one object is held on said receiving end an additional one of said objects passing from said upper location will engage said lever so as to rotate said discharge end downwardly to a position in which all of said objects on said lever move off of said lever, a wheel rotatably mounted adjacent to said lever, motion imparting means for rotating said wheel, escapement teeth means mounted on said wheel equidistant from one another, escapement pawl means located on said lever so as to interact with said teeth to permit limited rotation of said wheel each time said lever is rotated to said position in which said objects move off of said lever.

In accordance with the present invention such an apparatus is utilized in a game constructed so as to have a housing in which two walls are separated by dividers defining at least two paths between the lower and the upper ends of the housing. In such a game the wheel is located so that projections on the wheel serve as gates to regulate which of the paths are open in the sense that objects may be moved through them. In such a game a chute or chute means is provided for conveying objects from adjacent to the top of the housing downwardly toward the lever so as to operate the lever in the manner described. Such operation of the lever results in a change in the position of the wheel used. In the presently preferred game in accordance with the invention the objects are moved between the two walls noted through the use of magnetic coupling.

BRIEF DESCRIPTION OF THE DRAWINGS

The invention is best more fully explained with reference to the accompanying drawings in which.

The particular game illustrated is constructed so as to utilize the concepts and principles of the invention as set forth in the claims appended to this specification. These concepts and principles are of such a character that they can be utilized in a wide variety of different structures which differ from the precise game illustrated in appearance and/or utility. It is considered that those skilled in the art of mechanical movements will have no difficulty in utilizing the concepts and principles of the invention in a variety of diverse manners on the basis of the disclosure set forth herein.

DETAILED DESCRIPTION

Figure 2:
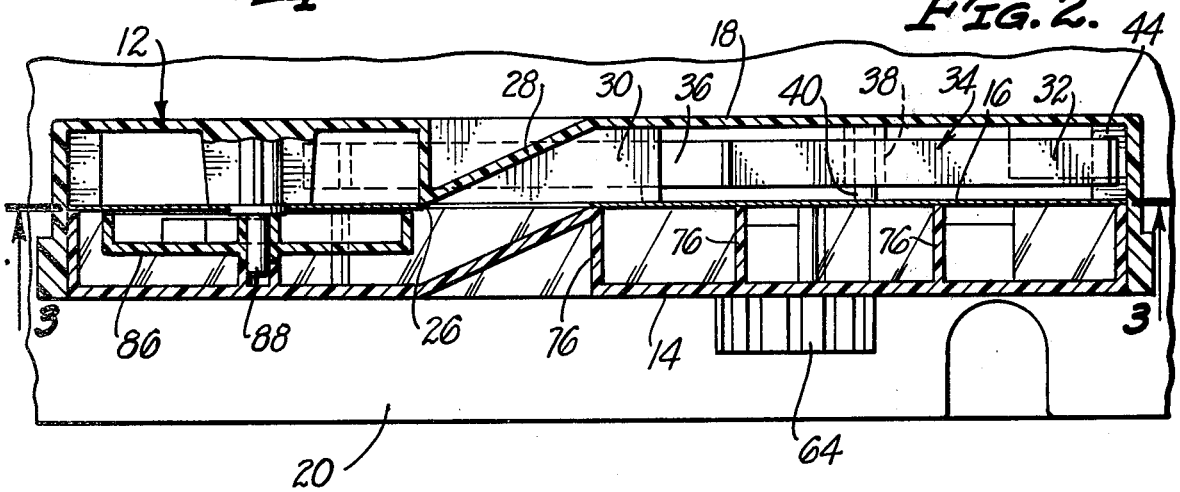
FIG. 2 is a cross-sectional view at an enlarged scale taken at line 2—2 of FIG. 1.

In the drawings there is shown a game 10 in accordance with this invention which is constructed so as to include a housing 12. This housing 12 includes a transparent front wall 14, an opaque intermediate wall 16, and a back wall 18. These walls 14, 16 and 18 are all vertically supported by an attached conventional base 20 and are joined by means of side walls 22 and a top wall 24. The intermediate wall 16 is constructed so as to include an opening 26 (FIG. 2) leading to a sloping surface 28 on the back wall 18. This sloping surface 28 leads downwardly to between spacing walls 30 extending from the back wall 18 so as to be in contact with the intermediate wall 16.

These two spacer walls in effect define a chute (not separately numbered) between the intermediate wall 16 and the back wall 18 which is directed at an angle generally toward the receiving end 32 of a lever 34. This lever 34 also includes a discharge end 36 located at a slight angle to the receiving end 32. It is mounted intermediate its ends 32 and 36 through the use of a cylindrical bearing 38 supported upon a small shaft 40 extending from the back wall 18. The receiving end 32 is provided with an enlarged weight 42 which is adapted to move the receiving end 32 generally downwardly into contact with a stop 44.

Figure 3:
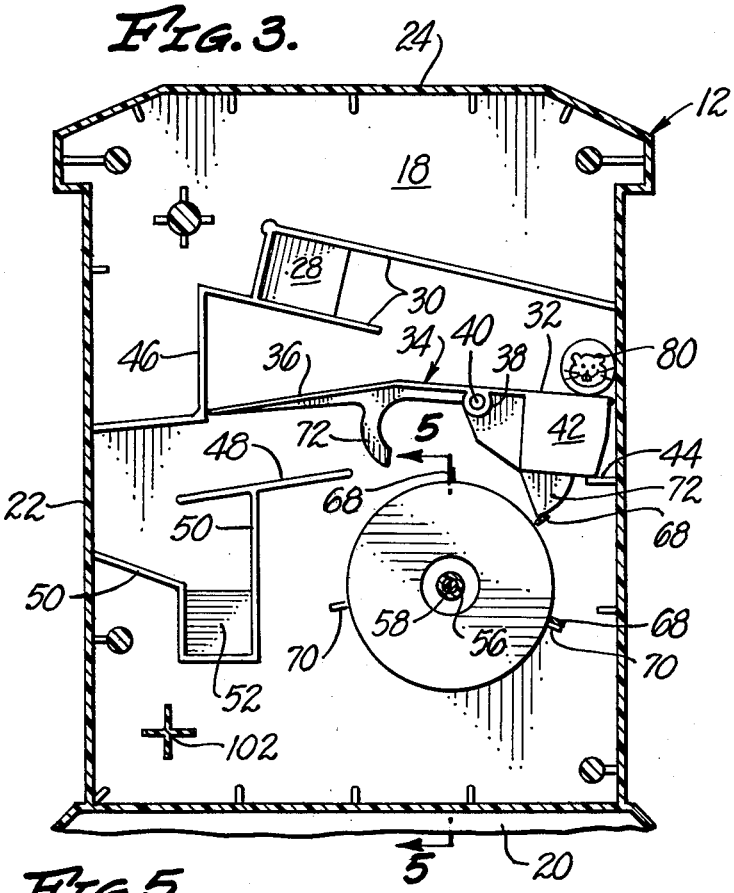
FIG. 3 is a cross-sectional view at the same scale as FIG. 1 taken at line 3—3 of FIG. 2.
Figure 4:
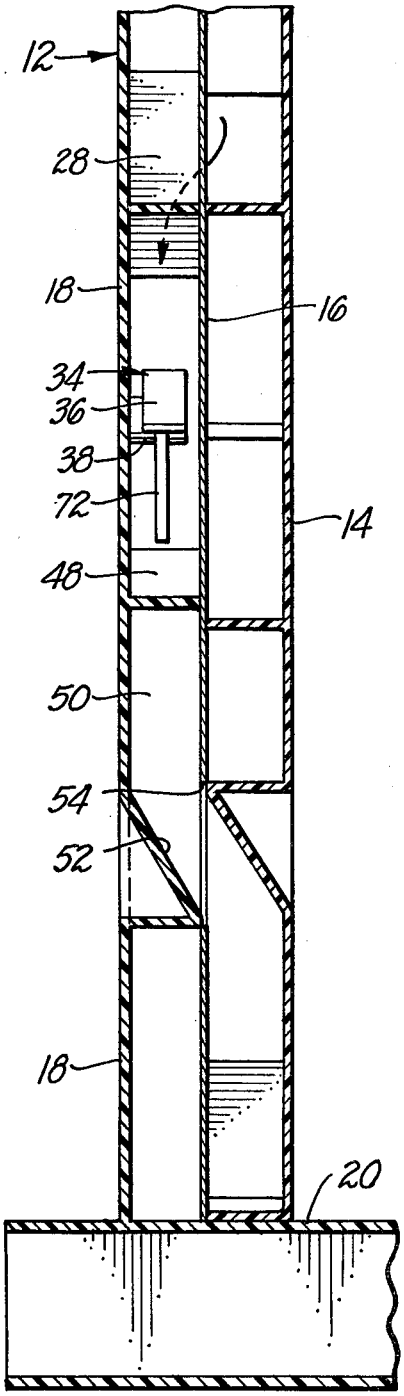
FIG. 4 is a partial cross-sectional view at an enlarged scale taken at line 4—4 of FIG. 1.
Figure 5:
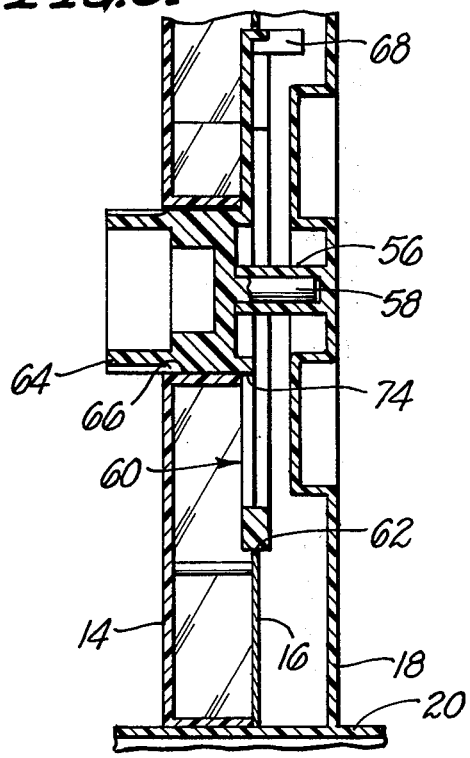
FIG. 5 is a partial cross-sectional view at an enlarged scale taken at line 5—5 of FIG. 1.

This stop 44 holds the receiving end 32 nearly horizontal. When this receiving end 32 is nearly horizontal the discharge end 36 extends downwardly at a slight angle to the horizontal so as to be directed toward a vertical spacing wall 46 (FIG. 3). The lever 34 is mounted on the shaft 40 in such a manner that the discharge end 36 may be pivoted downwardly toward another internal spacing wall 48. This wall 48 is spaced from the wall 46 in such a manner as to define in connection with spacing walls 50 a chute (not separately numbered) leading to a sloping surface corresponding to the surface 28 previously described. This surface 52 is adjacent to an opening 54 corresponding to the opening 26 in the intermediate wall 16.

The back wall 18 is provided with a forwardly directed cylindrical bearing 56 which serves to support a centrally located shaft 58 on a wheel 60. This wheel 60 extends through a circular opening 62 in the intermediate wall 16 and is spaced from the front wall 14. This wheel 60 carries a position setting knob 64 extending outwardly through a cylindrical bearing wall 66 in the front wall 14 so that the position of the wheel 60 may be maually adjusted. This wheel 60 is provided on its rear surface (not separately numbered) with a series of three equally spaced escapement teeth 68. These teeth 68 are positioned on the wheel 60 in positions in which the individual teeth 68 furtherest remote from one another will hit against stops 70 formed integrally with the back wall 18.

These teeth 68 are also located adjacent to escapement pawls 72 formed on the receiving and discharge ends 32 and 36 respectively of the lever 64. The teeth 68 and the pawls 72 are proportioned so as to cooperate with one another in the manner of a conventional clock anchor escapement. With this structure each time the lever 34 is pivoted so as to move the receiving end 32 away from the stop 44 the pawls 72 will be moved so as to permit limited rotation of the wheel 60 as the lever 34 returns to its original position with the receiving end 32 against the stop 44. In effect the wheel 60 will be "reset" for further advacement by movement of the pawls 72 relative to the teeth 68.

In order for such an escapement action to be achieved it is of course necessary to provide a structure or means for imparting rotation to the wheel 60 when the pawls 72 are moved so as to permit such rotation. In the game 10 such means for imparting rotation (not separately numbered) are integrally formed with the wheel 60 by the simple expedient of eccentrically weighting this wheel by forming in it an off center opening 74. Various indicia 75 are located in back of this opening 74 so that successive of these indicia 75 are visible as the wheel 60 is rotated in the manner hereinafter described. This is considered quite desirable in providing a visual indication or feedback to a child using the game 10 as the game is employed for its intended purpose that the child is in fact using the game 10 in a proper manner.

Figure 1:
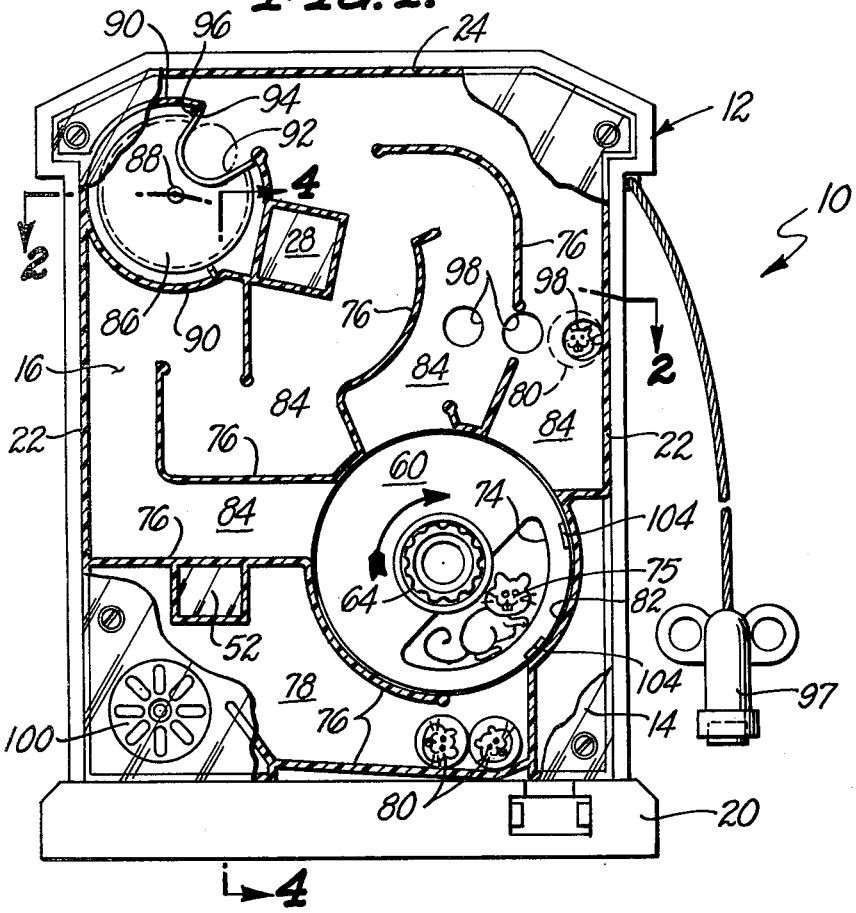
FIG. 1 is a front elevational view of a presently preferred embodiment of a game in accordance with the invention in which a part of a transparent wall is broken away so as to clearly show certain internal parts within the game.

When the wheel 60 is rotated in the direction indicated by the arrow in FIG. 1 through the use of the knob 64 the teeth 68 will "ratchet" relative to the pawls 72 so as to bring one of the teeth 68 into contact with a stop 70. In this position the pawls 72 will of course hold the wheel 60 against rotation until such time as the lever 34 is pivoted. In such a position the eccentric weight distribution within the wheel 60 will in effect bias the wheel 60 so it will automatically rotate when it is allowed to rotate as a result of movement of the lever 34.

In the game 10 a plurality of internal divider walls 76 are formed on the front wall 14 so as to extend therefrom to the intermediate wall 16. For convenience of explanation all of such divider walls 76 are indicated by the same numeral and separate numerals are used herein and in the drawing to designate various paths which are defined between the front and intermediate walls 14 and 16 by these divider walls 76.

The first of these paths is a path 78 leading from adjacent to the opening 54 to immediately adjacent to the periphery of the wheel 60. This path 78 is adapted to contain and hold a plurality of objects 80 adjacent to the base 20. In effect the walls 76 also define a circular cavity-like "path" 82 adjacent to the wheel 60 which is adapted to lead toward any of a plurality of other paths 84 which extend from adjacent to the wheel 60 upwardly toward a type of barrel valve member 86.

This valve member 86 is rotatably mounted on a shaft 88 extending from the back wall 18 and is located within other divider walls 90 corresponding to the walls 76 indicated in the preceding discussion and serving as a valve housing (not separately numbered). This valve member 86 is provided with a peripheral notch 92 which is adapted to receive one of the objects 80 at a time. When such an object 80 is located within the notch 92 it changes the balance of the valve member 88 so as to rotate the valve member 86 to a position in which such an object is moved between the walls 90 so as to pass through the opening 26 and along the surface 28.

It is noted that the notch 92 is located adjacent to a projection 94 on the valve member 86 which is adapted to abut against a corresponding projection 96 on one of the walls 90. This structure is designed so that the unbalanced character of the valve member 86 will return this member 86 so that the notch 92 is not in a completely vertical position relative to the shaft 88. As a result of this construction the valve member 86 always rotates in a desired direction when a member 80 is in it and easily and effectively returns to an initial position as indicated in FIG. 1 after it has been rotated.

In the preferred embodiment of the game 10 the objects 80 are either constructed of or include a ferromagnetic composition (not separately identified) so that a small hand-held magnet 97 can be manipulated so as to move a single one of these objects 80 at a time upwardly from a position as shown in FIG. 1 until such time as such object 80 is located within the notch 92. When an object 80 is located within the notch 92 the valve member 86 will rotate in the manner previously indicated so that the object 80 will be moved downwardly into contact with the receiving end 32 of the lever 34. Then another such object 80 can be moved in the same manner so as to again rest against the receiving end 32 of the lever 34. In order to provide a visual indication to a child various small openings 98 may be located in the intermediate wall 16 so that the objects 80 on the receiving end 32 may be viewed.

The lever 34 can be constructed so that after a predetermined number of the objects 80 are held by the receiving end 32 the downward movement of an additional object 80 will result in this last object hitting against the discharge end 36 adjacent to the shaft 40. When this occurs this last object 80 will roll along the discharge end 36. As a result of the well known leverage considerations this will tilt the discharge end 36 downwardly. As this occurs all the objects 80 held by the lever 34 will move downwardly so as to roll off of the lever 34. As soon as they all are off of the lever 34, the lever 34 will of course resume its initial position. The objects which have moved off of the lever 34 in this manner will engage the surface 52 and will pass into the path 78.

In order to attract the attention of a child it is preferred to locate a bell 100 immediately beneath this surface 52 so that each of such objects 80 will engage the bell 100 in passing into the path 78. This bell 100 may conveniently be mounted on a post 102 extending from the back wall 18 through the intermediate wall 16.

During each such rocking motion of the lever 34 as described in the preceding the pawls 72 will cooperate with the teeth 68 so as to permit the eccentric weight of the wheel 60 to rotate this wheel an incremental amount. As this occurs projections 104 on the wheel 60 serving as gates will be moved so as to block off successive of the paths 84. Hence, with this structure the more times a child has gone through the sequence of operations indicated in the preceding, the less ways or paths 84 the child has to repeat the sequence of operation in getting an object 80 from adjacent to the bottom (not separately numbered) of the housing 12 to adjacent to the top of the housing 12. As a consequence of this after objects 80 have been moved as indicated in the preceding so as to result in the advancement of the wheel 60 until such time as the action of the stop 70 prevents further rotation of the wheel 60 the wheel 60 must be reset by being turned in the direction of the arrow indicated in FIG. 1 before the game 10 can again operate in an intended manner.

I claim:

1. An apparatus in which objects are moved from an upper location to a lower location in which the improvement comprises:

an elongated lever adapted to receive downwardly passing objects from said upper location, said lever having a receiving end and a discharge end and being pivotally mounted intermediate said ends, said lever being weighted so that said receiving end will tend to move downwardly when there is no weight applied to said lever, stop means for limiting the downward movement of said receiving end to a position in which said receiving end is located generally beneath said upper location and is positioned so as to receive at least one object passing downwardly from said supper location, said lever being located with respect to said upper location so that after at least one object is delivered from said upper location and held on said receiving end an additional one of said objects passing from said upper location will engage said lever approximate the opposite side of said pivot so as to rotate said discharge end downwardly to a position in which all of said objects on said lever move off of said lever, a wheel rotatably mounted adjacent to said lever, motion imparting means for rotating said wheel, escapement teeth means mounted on said wheel equidistant from one another for positioning said wheel, an escapement pawl located on said lever so as to interact with said teeth to permit limited rotation of said wheel each time said lever is rotated to said position in which said objects move off of said lever and means for permitting said objects to be moved from said lower location to said upper location.

2. An apparatus as claimed in claim 1 wherein:

said motion imparting means comprises means causing an imbalance in said wheel.

3. An apparatus as claimed in claim 2 wherein:

said means causing said imbalance comprises an opening located eccentrically in said wheel.

4. An apparatus as claimed in claim 3 including:

a series of indicia located adjacent to said wheel so that successive of said indicia will be visible through said opening as said wheel rotates.

5. An apparatus as claimed in claim 1 wherein:

said wheel has an opening extending between its sides and including a plurality of indicia located adjacent to said wheel so that successive of said indicia are visible through said opening as said wheel is rotated.

6. An apparatus as claimed in claim 1 including:

a chute located at said upper location, an enclosed path located so as to receive said objects from said discharge end of said lever, a plurality of separate paths leading from said first mentioned path to said chute, means for manually manipulating said objects from said first mentioned path through any of said separate paths to said chute, and gate means on said wheel for blocking off one or more of said separate paths in accordance with the position of said wheel.

7. An apparatus as claimed in claim 6 wherein:

said motion imparting means comprises means causing an imbalance in said wheel.

8. An apparatus as claimed in claim 6 wherein:

said wheel has an opening extending between its sides and including a plurality of indicia located adjacent to said wheel so that successive of said indicia are visible through said opening as said wheel is rotated.

* * * * *